US006217195B1

(12) United States Patent
Turner et al.

(10) Patent No.: US 6,217,195 B1
(45) **Date of Patent: *Apr. 17, 2001**

(54) LAMP WITH SAFETY SHUTOFF FEATURES

(75) Inventors: Thomas M. Turner, Whitingsville; Michael A. Gariepy, Millville, both of MA (US)

(73) Assignee: The Holmes Group, Inc., Milford, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/056,427

(22) Filed: Apr. 7, 1998

Related U.S. Application Data

(60) Provisional application No. 60/043,434, filed on Apr. 7, 1997.

(51) Int. Cl.[7] ..... F21S 1/12

(52) U.S. Cl. ..... 362/276; 362/276; 362/802; 362/395; 362/394; 362/21; 362/376; 362/377; 362/378; 362/294; 362/264; 362/414; 362/804; 362/380

(58) Field of Search ..... 362/276, 802, 362/395, 394, 21, 376, 377, 378, 294, 264, 414, 804, 380

(56) References Cited

U.S. PATENT DOCUMENTS

| | | | | |
|---|---|---|---|---|
| 5,733,038 | * | 3/1998 | Wang | 362/276 |
| 5,863,111 | * | 1/1999 | Turner et al. | 362/410 |
| 5,902,037 | * | 5/1999 | Turner et al. | 362/376 |
| 6,039,462 | * | 3/2000 | Turner et al. | 362/410 |

* cited by examiner

*Primary Examiner*—Sandra O'Shea
*Assistant Examiner*—Anabel M. Ton
(74) *Attorney, Agent, or Firm*—Hoffmann & Baron, LLP; Francis E. Marino

(57) ABSTRACT

A lamp with improved safety features, to avoid fire and burn hazards, includes an electrical circuit having a thermostat connected in series with the bulb of the lamp. The thermostat is mounted in close proximity to the lamp's bulb and, upon the ambient air temperature in the vicinity of the thermostat reaching a predetermined temperature, the thermostat effectively opens the electrical circuit, shutting the lamp off. Once power is turned off for a period of time, the thermostat resets and the lamp may be operated again. A protective guard is positioned over at least a portion of the bulb of the lamp to prevent accidental burning. Alternatively, the electrical circuit further includes a detector for sensing an object being placed within the lamp shade and generating a signal in response thereto. The detector is electrically connected to a switching device which terminates power to the lamp in response to the detector signal.

10 Claims, 9 Drawing Sheets

LAMP WITH SAFETY SHUTOFF FEATURES

RELATED APPLICATIONS

This application claims priority from U.S. provisional application Ser. No. 60/043,434 filed on Apr. 7, 1997.

BACKGROUND OF THE INVENTION

1. Field of the Invention

The present invention relates to a lamp generally and, more particularly, to an improved floor lamp having safety features to prevent risk of fire and injury to persons.

2. Description of the Prior Art

Presently available standing floor lamps and, more particularly, lamps commonly referred to as "torchiere" halogen floor lamps, are known to produce a significant amount of heat from the 300 watt halogen light bulbs used therein. The heat of these light bulbs is a potential fire hazard as well as a burn hazard to persons coming in contact with the top portion or shade of the torchiere lamp or the halogen bulb itself.

Generally, manufacturers of these types of lamps provide warnings to the consumers with respect to potential fire and injury hazards which may be caused by extremely hot halogen lamps. Such warnings may include a tag attached to the power supply cord or a label attached to the inside of the shade near the halogen bulb to warn consumers of the potential burn hazard when changing a halogen bulb. To date, no manufacturer of torchiere style lamps provides any sort of built-in safety feature to protect the consumer from risk of fire or injury due to burns. Accordingly, the present invention is directed to providing safety features for the halogen torchiere style lamps to provide protection to the consumer against risk of fire and injury.

OBJECTS AND SUMMARY OF THE INVENTION

It is an object of the present invention to provide a lamp which includes safety features to prevent potential fire hazards.

It is another object of the present invention to provide a lamp having means for preventing a person from contacting the halogen bulb and risking possible injury due to burning and to prevent objects from coming in contact with the halogen bulb to prevent potential fire hazards.

It is yet a further object of the invention to provide a lamp having a thermostatic control which is responsive to ambient temperature in the cavity of a shade of an operating lamp which terminates power to the lamp upon air temperature within the shade reaching a predetermined temperature.

It is still a further object of the present invention to provide a lamp having a thermostatic safety feature in which the thermostat will not reset until power to the lamp is terminated for a period of time.

It is yet another object of the present invention to provide a safety switch which will terminate power to the lamp upon an object being placed within the open end of the shade.

It is still a further object of the present invention to provide a lamp having a sensor for terminating power to the lamp should an object be detected as being placed over the lamp by the sensor.

In accordance with one form of the present invention, an electric lamp includes a base for supporting the lamp and a stem portion having a first end coupled to the base and the second end coupled to a light bulb socket. The electric lamp further includes an electrical circuit for providing power to the light bulb socket, the circuit including an on/off switch and a thermostatic switch serially connected to the light bulb socket. The thermostatic switch is responsive to ambient air temperature such that, upon reaching a predetermined value, power to the light bulb socket is terminated or shut off. Preferably, the thermostatic switch includes a means for maintaining the switch in an open circuit position until power to the lamp is turned off for a period of time to allow the thermostatic switch to reset thereby permitting normal operation of the lamp. The means for maintaining the thermostatic switch may be in the form of a resistive heating element. When the thermostatic switch opens in response to ambient air temperature reaching the predetermined value, current is directed to the resistive heating element which maintains the ambient air temperature in the vicinity of the thermostatic switch above the predetermined value thereby preventing the thermostatic switch from resetting. Only upon termination of power to the lamp, e.g., turning the on/off switch to the off position or unplugging the lamp, will the thermostatic switch be allowed to cool down and reset.

Although the thermostatic switch and resistive heating element may each take many forms, the preferred embodiment of the present invention includes a thermostatic switch which is a bimetallic switch and a ceramic resistive heating element.

In order to provide a margin of safety with respect to fire hazards and potential personal injury, the predetermined temperature at which the thermostatic switch opens the electrical circuit is about 65° C. Furthermore, the thermostatic switch is preferably mounted in close proximity to the light bulb socket to sense the ambient air temperature in the hottest region of the lighting fixture.

Although the present invention may be used with any type of lamp, the safety features of the present invention are particularly useful with respect to halogen torchiere floor lamps. Such lamps use high intensity halogen bulbs, usually 300 watts. These lamps create significant heat and potential fire and personal injury hazards. These types of lamps usually include a bowl-shaped shade provided at the second end of the stem. To direct light in an upward direction, the shade includes positioned therein a reflector. Such lamps also include a dimmer means for controlling the intensity of illumination provided by the lamp.

The present invention also discloses a halogen torchiere floor lamp including a base for supporting the lamp, an elongated hollow stem having a first end coupled to the base and a shade coupled to the second end, a light socket positioned within the shade for receiving a halogen bulb and an electrical circuit means for providing power to the lamp. The halogen floor lamp further includes a protective guard mounted within an interior portion of the shade. The protective guard is positioned over at least a portion of the halogen bulb mounted within the light socket thereby obstructing access to the light socket and bulb with minimal obstruction of light. The protective guard is preferably a convex-shaped wire, but it is envisioned that the protective guard may take many different forms. The halogen floor lamp may also include a reflector located in a bottom portion of the shade and wherein the protective guard is mounted to opposite edges of the reflector.

The present invention also discloses an electrical circuit including a detector for sensing when an object is placed within the shade of the lamp and generates a signal in response thereto. The electrical circuit further includes a switching device for terminating power to the lamp in response to the signal generated by the detector. In a preferred embodiment, the detector is a phototransistor which energizes a relay coil upon detection of an object within and/or over a portion of the lamp shade. The changing state of the relay terminates power to the dimmer control module or the power supply to the lamp socket to shut the lamp off. Alternatively, the detector may be a safety switch having an actuator. Upon an object being placed within the lamp shade and in contact with the switch actuator, power to the lamp socket is terminated until the object is removed.

A preferred form of the standing floor lamp, as well as other embodiments, objects, features and advantages of this invention, will be apparent from the following detailed description of illustrative embodiments thereof, which is to be read in connection with the accompanying drawings.

DETAILED DESCRIPTION OF THE PREFERRED EMBODIMENTS

Figure 1:
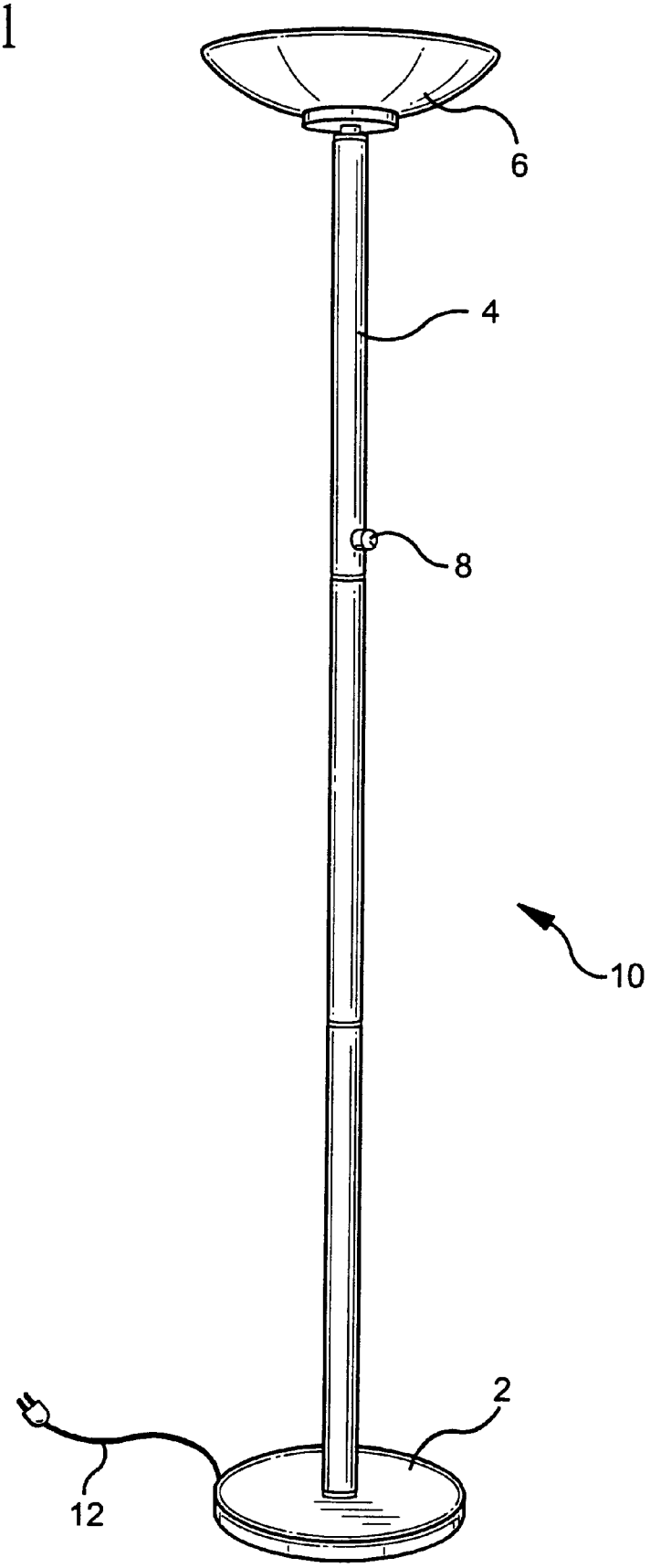
FIG. 1 is a perspective view of a standing floor lamp formed in accordance with the present invention.

The invention relates to safety features for lamps and, more particularly, for halogen torchiere-type standing floor lamps. Although the present invention is described herein for use with a torchiere lamp, it is envisioned that these safety features could be used in conjunction with any type of lighting fixture. As illustrated in FIG. 1, a torchiere lamp 10 formed in accordance with the present invention includes a lamp base 2 for supporting the fixture, an elongated stem 4 having a first end attached to a central portion of the base 2 and a second end coupled to a bowl-shaped shade 6. The stem is hollow and includes a rotary switch 8 for controlling the on/off function of the power supply to the lamp. Furthermore, the switch 8 has associated therewith a dimmer switch for controlling the intensity of the lamp in the on position. Lastly, the lamp includes a power cord 12 which can be plugged into any standard AC electrical outlet.

Figure 2:
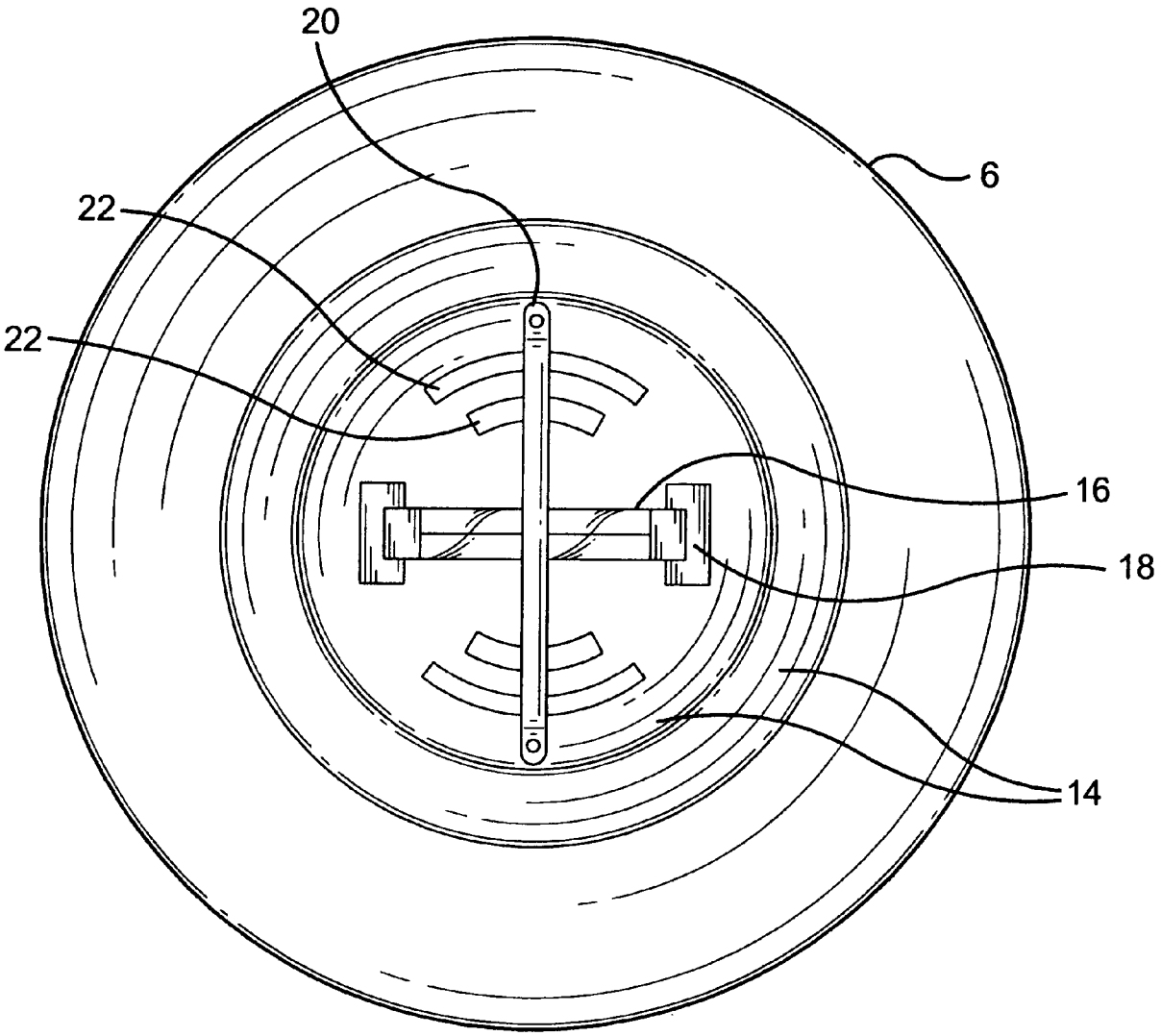
FIG. 2 is a top plan view of the standing floor lamp formed in accordance with the present invention.

FIG. 2 is a top plan view of the shade portion 6 of the lamp formed in accordance with the present invention. Within the shade portion of the lamp there is a reflector 14 which substantially reflects the light from the lamp in an upward direction. Positioned within the reflector is the halogen bulb 16 which is seated within a socket 18. The socket 18 is electrically connected to the rotary switch 8 and ultimately the power source through power cord 12. The reflector formed in accordance with the present invention includes several slots 22 through the thickness thereof Lastly, FIG. 2 illustrates a top view of a protective guard 20 which is positioned across and over at least a portion of the halogen bulb and mechanically connected to edges of the reflector 14.

Figure 5:
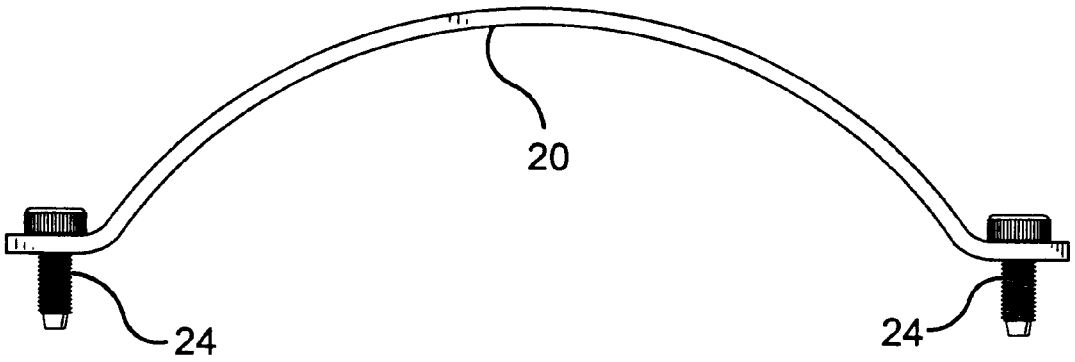
FIG. 5 is a side view of the protective guard shown in FIG. 2 formed in accordance with the present invention.
Figure 6:
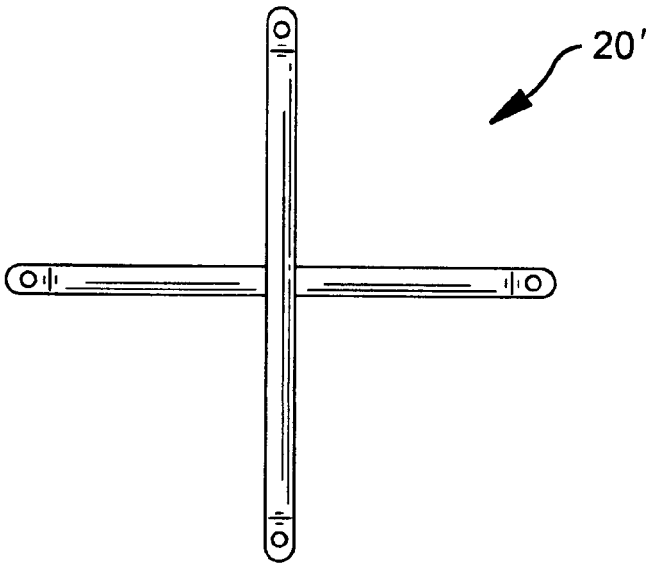
FIG. 6 is a top plan view of an alternative embodiment of the protective guard formed in accordance with the present invention.

Referring to FIGS. 2 and 5, the protective guard 20 has a substantially convex shape and is positioned perpendicular to the axis of the halogen bulb 16. The protective guard 20 may take any shape or form, e.g., a cage, as opposed to a single bar as shown in FIG. 5. The protective guard 20 will prevent a person from reaching up into the bowl portion of the lamp and possibly coming in direct contact with an extremely hot halogen bulb. Additionally, should something be placed over the shade 6, the protective guard 20 will keep such articles from directly contacting the halogen bulb. The protective guard 20 of the present invention provides the desired safety feature while obstructing the minimal amount of light produced by the lamp. Preferably, the protective guard formed in accordance with the present invention is made from a metal wire having mounting holes formed at opposite ends thereof. Machine screws 24 may be used to attach the protective guard to the edges of the reflector housed within the lamp shade 6. As previously noted, the protective guard may take the form of an open wire cage (not shown) to provide even more protection against possible contact with a potential burn hazard. As illustrated in FIG. 6, the protective guard, i.e., protective guard 20', may be formed from two wires crossed in the middle.

Figure 3:
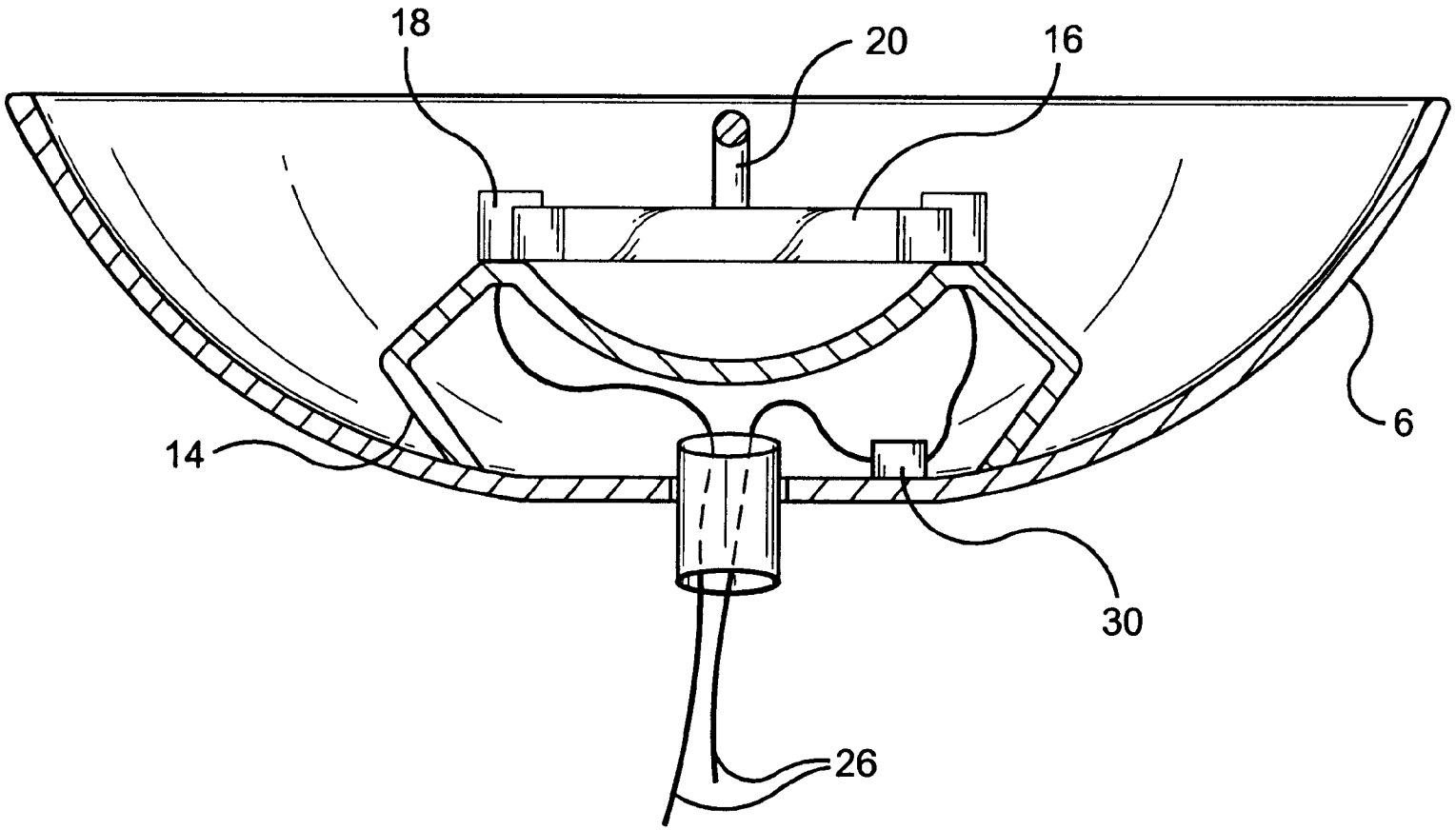
FIG. 3 is a cross-sectional view of the shade portion of the standing floor lamp formed in accordance with the present invention.

FIG. 3 is a cross-sectional view of the top shade portion 6 formed in accordance with the present invention. As illustrated in FIG. 3, the reflector 14 is mounted to a lower surface of the shade 6. The reflector includes positioned therein the sockets 18 for receiving a halogen bulb 16. Also illustrated in FIG. 3 is protective guard 20 which extends over the bulb mounted in the sockets.

The present invention is directed toward safety features for torchiere type halogen lamps. Accordingly, a torchiere lamp formed in accordance with the present invention includes a thermostat switch to prevent overheating of the lamp and a possible fire hazard. The thermostat switch 30, as illustrated in FIG. 3, is located in close proximity to the halogen bulb, namely, the area between the reflector 14 of the lamp and the metal shade 6.

Figure 4:
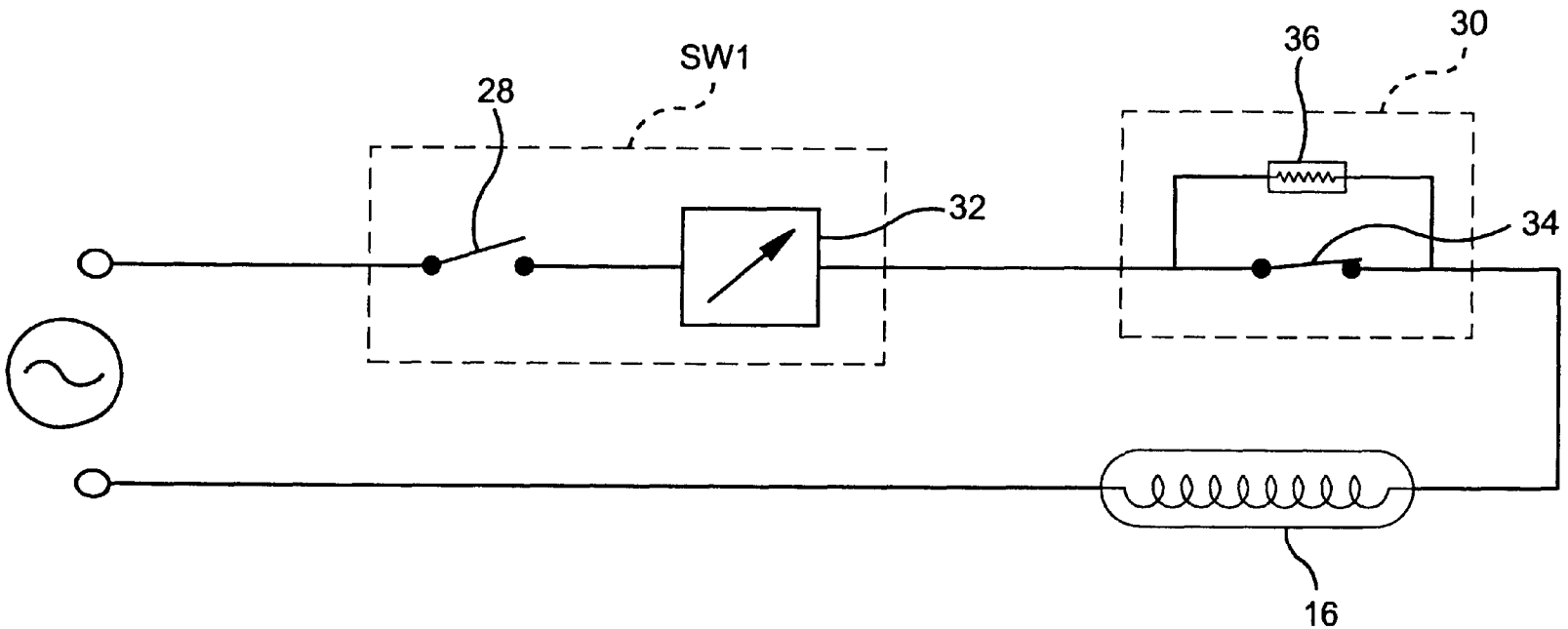
FIG. 4 is an electrical schematic of the circuit associated with the lamp formed in accordance with the present invention.

FIG. 4 is a circuit diagram for the torchiere lamp formed in accordance with the present invention. The circuit includes a power source for providing AC power to the lamp. The power source is connected in series with a switch SW1 which includes an on/off switch 28 in combination with a dimmer switch 32 so that the intensity of the light may be varied from a dim glow to a high intensity. Any known dimmer switch circuitry may be used. For example, a dimmer circuit using a triac has proven to work well in rotary on/off switches, used for lighting fixtures. In normal operation, the switch SW1 will control the intensity of the illumination from the lamp.

To provide the safety feature of the lamp formed in accordance with the present invention, a thermostat is connected in series between the switch SW1 and the socket 18 for the halogen bulb 16. Preferably, the thermostat includes a bimetallic contact 34 and a parallel connected heating element 36. As illustrated in FIG. 3, the thermostat 30 is mounted in close proximity to the halogen bulb 16. Furthermore, as illustrated in FIG. 2, the reflector 14 includes slots formed therein so that heat is readily transferred to the area in which the thermostat is mounted. If the temperature of the ambient air surrounding the thermostat reaches a predetermined temperature based upon the rated temperature of the thermostat, the bimetallic contact will change from a short circuit to an open circuit and the voltage supply is then applied across the heating element 36. Preferably, the heating element is a ceramic element which has been heated by the ambient air and, upon current being applied to the element, generates sufficient heat to maintain the bimetallic contact in an open position until power to the lamp is disconnected by either turning the switch to the off position or unplugging the lamp. Only power disruption will allow the ceramic heating element to cool down and permit the bimetallic element to return to a closed position thus allowing the lamp to operate under normal conditions again. Preferably, the ceramic heating element is a limiting resistor so that current is limited to only the current necessary to maintain the bimetallic contact in an open position. This limited current will not be sufficient to illuminate the halogen bulb.

It will be understood by those of ordinary skill in the art that the thermostat may take many forms. However, in the preferred embodiment, to provide for extra safety, a thermostat which cannot reset until power to the lamp is disconnected is most desirable. Such a thermostat is manufactured by Micro Therm under part no. A71C65-5. In the preferred embodiment, the predetermined temperature for the bimetallic contact to open is 65° C. Furthermore, the time required for the ceramic element to cool and the bimetallic contact to once again reset and close is preferably a sufficient amount of time to allow the entire lamp assembly to cool down, i.e., approximately 10 minutes. Once the bimetallic contact has reset to a closed condition and the ceramic heating element has been allowed time to cool, the lamp will be able to operate under normal conditions.

Generally, overheating conditions occur if an obstruction to the air flow occurs in the area of the shade 6 thus causing the temperature to rise to an unacceptable level. For example, a curtain or other drapery may be in close proximity to a torchiere lamp similar to that formed in accordance with the present invention. Due to the extremely high temperatures generated by a 300 watt halogen bulb, it is possible that the drapery may ignite causing a fire. The present invention including a circuit having a thermostat to terminate power to the lamp upon ambient air temperature around the lamp reaching a predetermined set point, provides greater safety and substantially eliminates any fire hazard. Accordingly, the halogen torchiere lamp formed in accordance with the present invention overcomes the disadvantages of prior art lamps and provides greater safety to the consumer. These safety features include both the thermostat cutoff as well as the protective guard positioned above the halogen lamp to prevent possible injury caused by burns due to the heat generated by a 300 watt halogen lamp.

Figure 7:
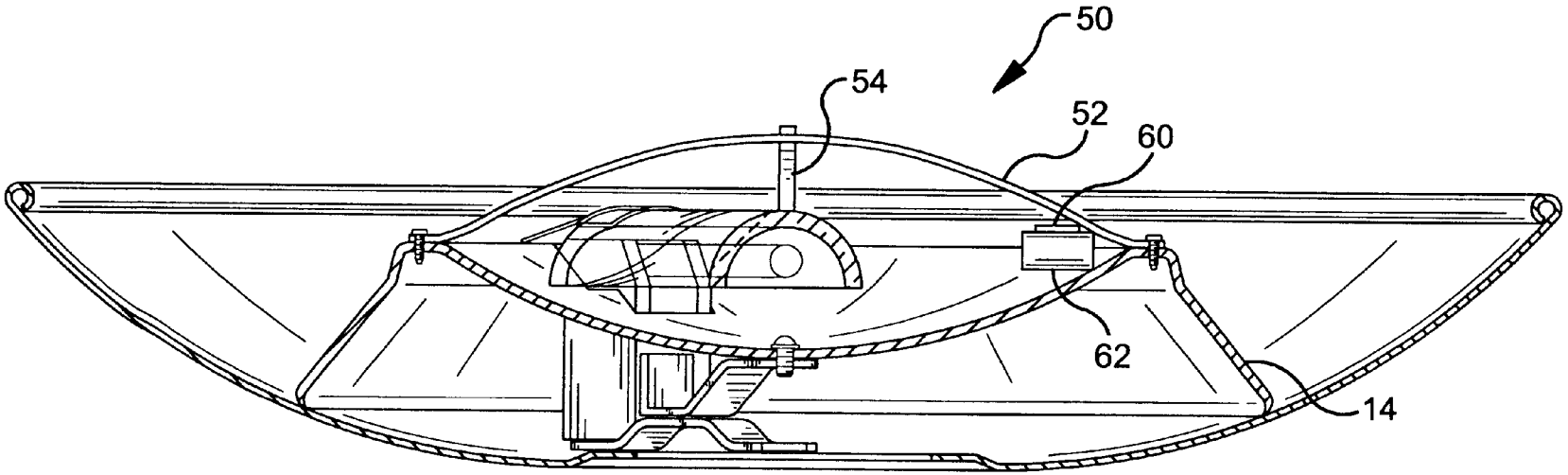
FIG. 7 is a cross-sectional view shade of a floor lamp including a safety switch formed in accordance with the present invention.

In one particularly preferred embodiment, the protective guard, i.e., protective guard 50 shown in FIG. 7, includes a pair of elongate intersecting wire members, i.e., lower wire member 52 and upper wire member 54, which each span from one side of reflector 14 to other side, thus forming an X-shaped dome structure which obstructs access to the halogen bulb by such objects as drapes and curtains without significant blockage of light. Wire members 52, 54 are preferably spaced 90° apart from one another about the upper periphery of reflector 14. Of course, it is contemplated herein that the protective guard could employ more than two wire members. It is also contemplated that the members of the protective guard could be secured to the shade or the light socket rather than the reflector.

The wire member 52 may include a U-shaped detent formed at the center thereof The U-shaped detent is sized to receive wire member 54 therein. As will be appreciated by those skilled in the art, wire member 54, once captured within U-shaped detent, is substantially locked in an upright, vertically oriented position, i.e., it is unable to rotate about the reflector. Each of the wire members preferably has an arch-like configuration to enhance the structural rigidity of the resultant protective guard structure.

As will be appreciated by those skilled in the art, it is desirable that the protective guard be installed at the factory, leaving little or no assembly left for the end user upon unpackaging of the lamp. Although protective guards such as protective guard 20 provide the required degree of protection, the rigid non-rotatable members employed in such structure either 1) require that the structure be assembled by the purchaser after unpackaging the lamp or 2) require its own unique packaging (as compared to packaging for lamps without such guard structures). However, it has been discovered herein that protective guard 50 can be installed on the lamp at the factory and still be packaged in the same packaging used for lamps without such guard structures.

In one embodiment, the protective guard structure includes guard members which are permanently fastened to opposing sides of reflector 14 (or alternatively to the shade), but are sufficiently flexible as to allow collapsing thereof for packaging. As shown in FIG. 7, the protective guard structure, i.e., protective guard 50, includes resilient guard members 52, 54. Also shown is a safety switch 60 which terminates power to the lamp should an object come in contact with the switch. Guard members 52, 54 are attached to the reflector by, for example, sheet metal screws. Because the guard members are formed from a resilient material, they may be collapsed for packaging of the lamp and are flexible enough to engage an actuator 60 of a safety switch 62 should an object be placed in contact with the protective guard. Once unpackaged, the resilient guard members return to the dome configuration, thus providing a protective guard structure which obstructs access to the halogen bulb while minimizing obstruction of light from the bulb. It will be appreciated by those skilled in the art that the safety switch may be placed anywhere within the lamp shade to detect if a foreign object is situated within the shade. A more detailed description of the electrical circuit associated with the safety switch appears below.

It will be readily apparent to one skilled in the art, and envisioned to form part of the invention to use similar components, although not necessarily identical to those described in the preferred embodiment to provide the safety features discussed herein. Specifically, many different types of thermostats may be used as well as many types of designs for the protective guard.

Figure 8:
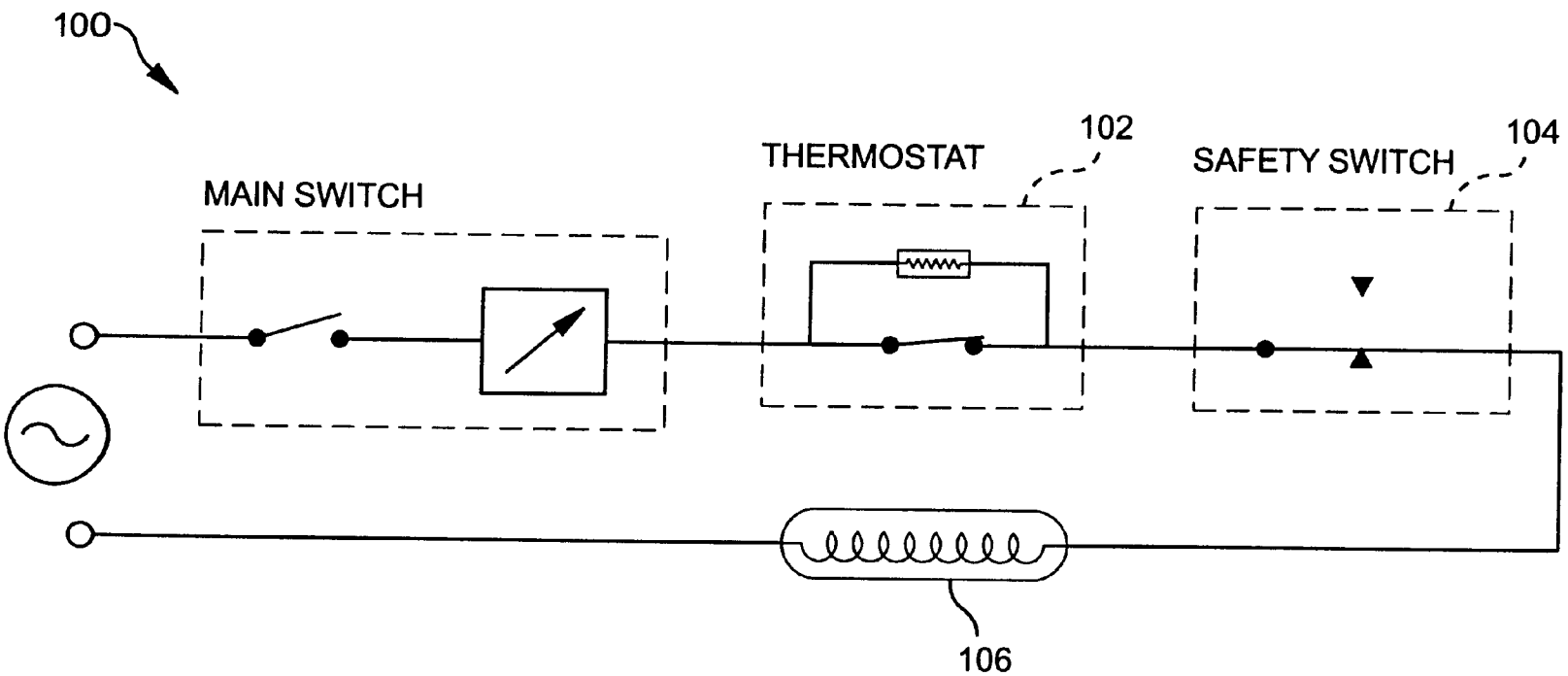
FIG. 8 is an electrical schematic including a thermostat and a safety switch formed in accordance with the present invention.

To further enhance the safety of the lamp and avoid fire and burn hazards, the lamp of the present invention may include an electrical circuit 100 as shown in FIG. 8 having a thermostat 102 and a safety switch 104 connected in series with a bulb 106 of the lamp. The thermostat 102 and the switch 104 are preferably mounted in close proximity to the lamp's bulb within the lamp shade, although many suitable locations for each switch will be readily known to those of ordinary skill in the art. Upon the ambient air temperature in the vicinity of the thermostat reaching a predetermined temperature, the thermostat effectively opens the electrical circuit, shutting the lamp off. As earlier discussed, the thermostat preferably includes a heating element to maintain the open circuit and once power is turned off for a period of time, the thermostat can reset and the lamp may be operated again.

As earlier discussed, the present invention also discloses a protective guard which is positioned over at least a portion of the bulb of the lamp. Referring to FIG. 7, the guard is either formed of flexible material or may be spring loaded and upon an object coming to rest on top of the guard, the guard will be pushed downward. When the guard comes in contact with the actuator 60 of the switch 63, the electrical circuit opens thus shutting off the lamp. When the object is removed from the guard, the lamp may again be operated normally. The switch 62 may be located in any convenient location within the interior space of the lamp shade to detect a foreign object being placed therein. Additionally, the switch may take many forms which will be well known to those of ordinary skill in the art.

Figure 9:
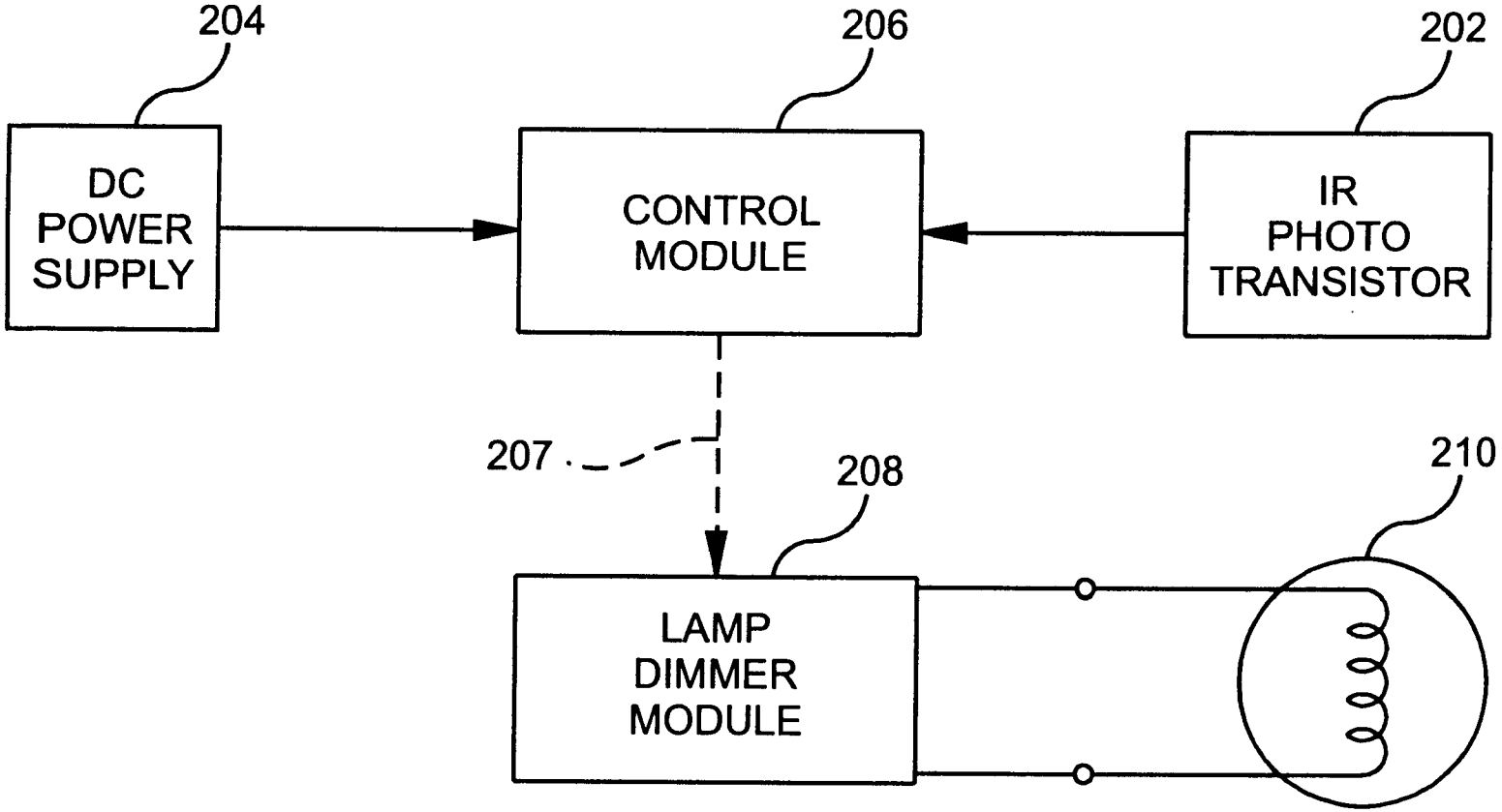
FIG. 9 is an electrical block diagram illustrating a protection circuit including a sensor formed in accordance with the present invention.
Figure 10:
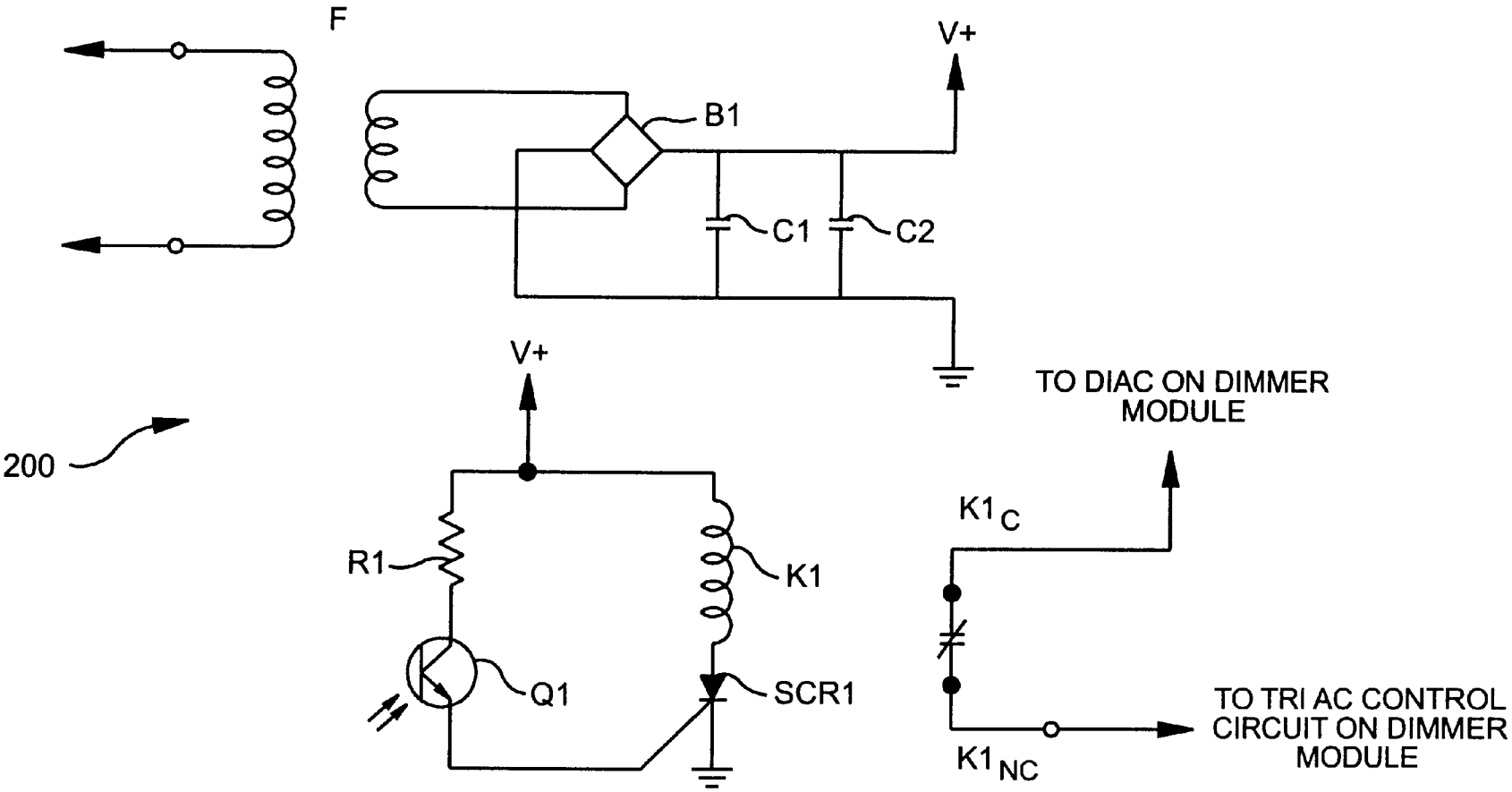
FIG. 10 is an electrical circuit used in connection with the embodiment of FIG. 9.

Referring to FIGS. 9 and 10, an alternative embodiment of the present invention including a sensor for detecting when an object is placed on or falls on top of the lamp is illustrated.

Referring to FIG. 9, the protection circuit includes an infrared photo transistor 202 for sensing reflected energy when an object is placed over or within the shade of the lamp. The protection circuit preferably includes a DC power supply 204 (converted from the AC input) electrically connected to a control module 206. The infrared phototransistor 202 is electrically connected to the control module and provides an input thereto. Upon an object being sensed by the infrared phototransistor 202, the control module 206 sends a control signal 207 to a dimmer module 208 to terminate power to the lamp 20.

Referring to FIG. 10, a more detailed circuit schematic of the protection circuit of FIG. 9 is shown. The phototransistor may take any known form and preferably is an NPN infrared phototransistor Q1. The protection circuit also includes a current limiting resistor R1 (470 Ω). The DC power supply 204 is preferably provided by a transformer T1 having a 6.2 VAC secondary winding. The secondary winding is electrically connected to a bridge rectifier B1, preferably 50 V or greater. The DC power supply further includes two capacitors, capacitor C1 (47 μf at 16 V) which acts to eliminate DC ripple and a decoupling capacitor C2 (0.1 μf) to eliminate any high frequency component of the DC output.

The protection circuit 200 of FIG. 10 is activated as follows:

1) Reflected infrared energy from the light is directed into the phototransistor Q1.
2) The phototransistor Q1 conducts and thereby pulls gate current through silicon controlled rectifier SCR1 and energizes the coil of relay K1 (5 VDC SPST relay).
3) Relay K1 contacts open. A suitable light sensitive dimmer switch circuit for use with the protective circuit 200 is disclosed in commonly-owned U.S. patent application Ser. No. 08/714,896, filed on Sep. 17, 1996, the disclosure of which is incorporated herein by reference. When the relay contacts are non-conducting or open the DIAC signal path to the TRIAC, both located in the lamp dimmer module as set forth in U.S. patent application Ser. No. 08/714,896 is opened, thus terminating power to the light bulb socket.
4) Gate current through SCR1 maintains relay coil K1 energized thereby keeping the lamp de-energized until the lamp switch is turned off, or the power line cord is removed from power receptacle, allowing the protection circuit to reset.

In an alternative embodiment in which the lamp does not include a dimmer module as defined herein, the relay K1 contacts are electrically connected to control the power supply to the lamp socket thus terminating power to the lamp in response to a signal from the phototransistor.

Although, illustrative embodiments of the present invention have been described herein with reference to the accompanying drawings, it is to be understood that the invention is not limited to those precise embodiments, and that various other changes and modification may be effected therein by one skilled in the art without departing from the scope or spirit of the invention.

What is claimed is:

1. A torchiere-style standing floor lamp comprising:

a base for supporting the lamp;

an elongated stem having a first end connected to the base and a second end connected to a closed end of substantially bowl-shaped shade;

a light socket positioned wit h an interior cavity of the shade; and an electrical circuit for providing power to the light socket, the electrical circuit including a safety switch positioned within the shade for detecting the presence of a foreign object within the cavity of the shade and terminating power to the light socket.

2. A torchiere-style lamp as defined in claim 1, wherein the safety switch includes an actuator such that the foreign object in contact with the actuator opens the electrical circuit terminating power to the light socket.

3. A torchiere-style standing floor lamp comprising:

a base for supporting the lamp;

an elongated stem having a first end connected to the base and a second end connected to a closed end of substantially bowl-shaped shade;

a light socket positioned with an interior cavity of the shade;

an electrical circuit for providing power to the light socket, the electrical circuit including a safety switch positioned within the shade for detecting the presence of a foreign object within the cavity of the shade and terminating power to the light socket; and a protective guard positioned over at least a portion of the light socket and the safety switch including an actuator such that a foreign object in contact with the protective guard moves the guard to contact the actuator of the switch thereby terminating power the light socket.

4. A torchiere-style lamp as defined in claim 1, further including a thermostatic switch positioned with the lamp shade and electrically connected in series with the safety switch, whereby upon ambient temperature within the shade reaching a predetermined value, the thermostatic switch changes state to terminate power to the lamp socket.

5. A torchiere-style standing floor lamp comprising:

a base for supporting the lamp;

an elongated stem having a first end connected to the base and a second end connected to a closed end of a substantially bowl-shaped shade;

a light socket positioned within an interior cavity of the shade; and an electrical circuit for providing power to the light socket, the electrical circuit including a sensor for detecting the presence of a foreign object positioned over or within the lamp shade, said sensor including a switch device for terminating power to the lamp socket upon detection of a foreign object.

6. A torchiere-style standing floor lamp as defined in claim 5, wherein the sensor comprises an infrared phototransistor.

7. A torchiere-style standing floor lamp as defined in claim 5, wherein the electrical circuit includes a power switch and a latching means for maintaining the sensor in an open circuit state upon detection of a foreign object. The latching means resetting only upon turning the power switch to an off position or removing a power cord from a receptacle.

8. An electrical circuit for a torchiere-style standing floor lamp having an open ended bowl-shaped shade comprising:

a detector for sensing an object being placed within the shade and generating a signal in response thereto, a switching device electrically connected to the detector for terminating power to the lamp in response to the signal generated by the detector.

9. An electrical circuit as defined in claim 8, wherein the detector is a phototransistor.

10. An electrical circuit as defined in claim 8, wherein the detector is a safety switch having an actuator.

* * * * *